US006555300B2

(12) United States Patent
Kokeguchi et al.

(10) Patent No.: US 6,555,300 B2
(45) Date of Patent: Apr. 29, 2003

(54) IMAGE FORMATION PROCESS

(75) Inventors: Noriyuki Kokeguchi, Hino (JP); Hiroyuki Hoshino, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/006,815

(22) Filed: Dec. 5, 2001

(65) Prior Publication Data

US 2002/0106591 A1 Aug. 8, 2002

(30) Foreign Application Priority Data

Dec. 12, 2000 (JP) ..... 2000-377045

(51) Int. Cl.[7] ..... G03E 7/407
(52) U.S. Cl. ..... 430/403; 430/404; 430/466
(58) Field of Search ..... 430/403, 404, 430/466

(56) References Cited

U.S. PATENT DOCUMENTS 5,200,302 A * 4/1993 Iwano ..... 430/376
5,695,916 A * 12/1997 Fyson ..... 430/403

* cited by examiner

*Primary Examiner*—Hoa Van Le
(74) *Attorney, Agent, or Firm*—Muserlian, Lucas and Mercanti

(57) ABSTRACT

An image formation process of a silver halide color photographic light sensitive material is disclosed, rising coating a processing solution containing a color loping agent onto the exposed photographic material in a coating section to perform development, while supplying the processing solution to the coating section, wherein the processing solution has a viscosity of 10.1 to 15000 cp at 25° C. and the processing solution being supplied to the coating section at a supplying rate of 0.002 to 2.0 ml/sec.

15 Claims, 1 Drawing Sheet

IMAGE FORMATION PROCESS

FIELD OF THE INVENTION

The present invention relates to an image formation process of a silver halide photographic light sensitive material.

BACKGROUND OF THE INVENTION

Silver halide photographic light-sensitive materials (hereinafter, also denoted simply as photographic materials) are used as a recording material which is simple and low in cost but nonetheless capable of providing high quality images. These materials have greatly contributed to the advancement of industry and culture, and are indispensable material Silver halide color photographic material such as color negative film, after exposure, is subjected to color development to form yellow (Y), magenta (M) and cyan (C) dye images along with formation of silver images, which is subsequently subjected to bleaching to bleach the silver images to silver halide. The thus formed silver halide becomes a soluble silver complex and is removed from the photographic material. The photographic material is further subjected to a stabilization treatment to wash out any residual fixing agent and to cleanse the photographic material.

In the universally employed processing for color negative film (e.g., Process C-41 or Process C-41RA, produced by Eastman Kodak Co.), the foregoing four processing steps (i.e., color developing, bleaching, fixing and stabilizing) are needed and controls thereof complex and a plenty of time is taken to dissolve processing chemicals. In case when processing a photographic material with immersing it into sufficient amounts of processing solutions used for photographic materials (hereinafter, also denoted simply as processing solutions) contained in processing tanks such as developer tank, bleach tank and fixer tank, while transporting the photographic material through a roller transport mechanism or hanger transport mechanism, processing the photographic material consumes effective ingredients coating roller. As a result of study of this proposal, contained in the processing solutions of the processing tanks, resulting in exhausted processing solutions. In addition thereto, for example, alkaline developer solution absorbs carbon dioxide gas in the air with time and the resulting neutralization reaction lowers alkalinity of the developer solution or aerial oxidation results in exhaustion of the solution with time. Recently, on-site processing, so-called mini-lab has increased to enhance convenience of color film processing, for which a compact and rapid-accessible photographic processing system is desired, which can be handled even by a non-specialist or a part-time worker and is simple, safe and friendly to the environment.

Accordingly, to reduce load of the foregoing process, for example, a technique was proposed in JP-A No. 3-59655 (hereinafter, the term, JP-A refers to an unexamined and published Japanese Patent Application), in which a coating roller is arranged on the way of transporting a photographic material, a supplying roller to supply a processing solution to the photographic material, a processing solution sump is provided between the coating roller and supplying roller so that the processing solution is supplied to the imaging side of the photographic material with coating by rotating the coating roller. As a result of study of this proposal, however, it was proved that such processing often caused unevenness in coating and also produced problems in reproducibility of processing.

Nowadays, in the so-called-digitization age, it is common that image information is optically read out from n photographed and processed film to form images, using an image sensor such as film scanner, converted to electric signals and digitized, thereby, the image information can be stocked as signals and subjected to computer processing to obtain dye images using a photo-copy or a hard copy. In such an imaging process is generally performed an image input by using a digital camera provided with a solid-state image sensor as well as conventional silver salt photographic films (such as color negative film). However, high quality images cannot be obtained by low-priced digital cameras which are relatively low in pixel density and narrow in dynamic range and which is very much expensive relative to a conventional lens-fitted film. On the other hand, the process of reading image information after subjecting a photographic material to a simple processing inherently has the foregoing problems involved in photographic processing and is also not a satisfactory one.

SUMMARY OF THE INVENTION

In view of the foregoing, it is a first object of the invention to provide an image formation process, which is low in hazardousness, improved in handling ability, simple and low-priced.

It is a second object of the invention to provide an image formation process, which is capable of promptly taking dye image information as digital information and at a low cost from a universally employed color negative film.

The above objects of the invention can be accomplished by the following constitution:

1. An image formation process of a silver halide color photographic light sensitive material comprising a support having thereon at least one silver halide emulsion layer, the process comprising the steps of:

(a) exposing the photographic material to light, and (b) coating a processing solution containing a color developing agent onto the exposed photographic material in a coating section to perform development, while supplying the processing solution to the coating section, wherein the processing solution has a viscosity of 10.1 to 15000 centi-poise (cp) at 25° C. and the processing solution being supplied to the coating section at a supplying rate of 0.002 to 2.0 ml/sec;

2. An image formation process of a silver halide color photographic light sensitive material comprising a support having thereon at least one silver halide emulsion layer, the process comprising the steps of:

(a) exposing the photographic material to light, (b) coating a processing solution containing a color developing agent onto the emulsion layer side of the exposed photographic material in a coating section to perform development, while supplying the processing solution to the coating section, and (c) reading image information from the developed photographic material by an image sensor to transform the read image information into digital image information, wherein the processing solution has a viscosity of 10.1 to 15000 cp at 25° C. and the processing solution is supplied to the coating section at a supplying rate of 0.002 to 2.0 ml/sec, and at step (c), the developed photographic material has a processing solution-coating weight of 0.2 to 40 times a maximum water absorption amount of the photographic material;

3. An image formation process of a silver halide color photographic light sensitive material comprising a support having thereon at least one silver halide emulsion layer, the process comprising the steps of:

(a) exposing the photographic material to light, (b) coating a processing solution containing a color developing agent onto the emulsion layer side of the exposed photographic material in a coating section to perform development, while supplying the processing solution to the coating section, and (c) reading image information from the developed photographic material by an image sensor to transform the read image information into digital image information, wherein the processing solution has a viscosity of 10.1 to 15000 cp at 25° C. and containing the color developing agent in an amount of 40 to 200 mmol/l, the processing solution being supplied to the coating section at a supplying rate of 0.002 to 2.0 ml/sec; the coating section is arranged apart from the photographic material so that a spacing between the coating section and the photographic material is maintained at 0.8 to 15 times a total dry layer thickness of the photographic material; and at step (c), the photographic material has a processing solution-coating weight of 0.2 to 40 times a maximum water absorption amount of the photographic material;

4. An image formation process of a silver halide color photographic light sensitive material comprising a support having thereon at least one silver halide emulsion layer, the process comprising the steps of:

(a) exposing the photographic material to light, (b) coating a processing solution containing a color developing agent onto the emulsion layer side of the exposed photographic material in a coating section to perform development, while supplying the processing solution to the coating section, and (c) reading image information from the developed photographic material by an image sensor to transform the read image information into a digital image information, wherein the processing solution has a viscosity of 10.1 to 15000 cp at 25° C. and a pH of 10.3 to 14.0, and the processing solution being supplied to the coating section at a supplying rate of 0.002 to 2.0 ml/sec; and at step (c), the photographic material has a processing solution-coating weight of 0.2 to 40 times a maximum water absorption amount of the photographic material.

DETAILED DESCRIPTION OF THE INVENTION

Figure 1:
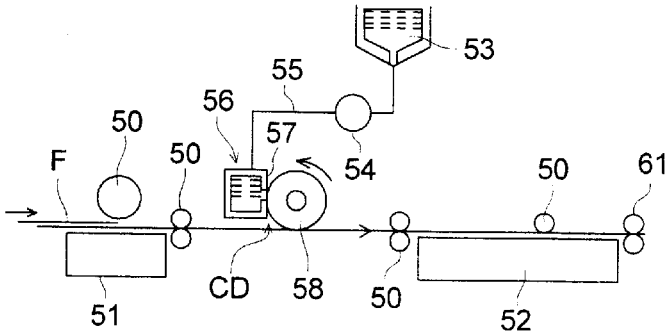
FIG. 1 illustrates an example of a processing apparatus used in the image formation process according to the invention.

Coating System and Supplying Amount of Processing Solution

The present invention concerns an image formation process, which comprises providing, by a coating system, a processing solution containing a color developing agent onto the emulsion layer side of an exposed silver halide color photographic material to perform development, in which the processing solution has a viscosity of 10.1 to 15000 cp at 25° C. and the processing solution being supplied to a coating section at a rate of 0.002 to 2.0 ml/sec.

The expression, providing a processing solution by a coating system refers to supplying the processing solution onto the emulsion layer side of the photographic material at a constant rate through a coating system. Not include in this case is a process of immersing a photographic material into a tank filled with a processing solution to cause ingredients to permeate into the photographic material through diffusion from the bulk solution. Means for providing a processing solution through a coating system include, for example, coating the solution by a member such as a roller and directly supplying the solution by a means, such as curtain coating. Exemplary examples of the coating system include an air doctor coater, blade coater, rod coater, knife coater, squeeze coater, immersion coater, reverse roller coater, transfer roller coater, curtain coater, double roller coater, slide hopper coating, gravure coater, kiss-roll coater, bead coater, cast coater, spray coater, calender coater, and extrusion coater.

When processing photographic materials, a processing solution is continuously supplied to a coating section and the processing solution is supplied (or coated) onto a photographic material. In cases where the processing solution is coated in a coating section provided with a coating means such as an extrusion coater, the processing solution is continuously supplied to a discharge orifice and extruded from the discharge orifice. Thus, the processing solution is extruded from the discharge orifice by pressure produced by a change in volume when the processing solution is extruded. In the invention, as a means for supplying a processing solution to the coating section, it is preferable to extrude a processing solution at a constant rate by continuously giving the processing solution a change in volume. Specifically, a metering pump or a method of causing liquid pressure by applying weight or through difference in liquid level and controlling the liquid amount by an orifice (weight-applying speed control system) is preferred as a means for supplying a processing solution. Preferred examples of the metering pump include a tube pump, a plunger pump, an electromagnetic metering pump and gear pump for addition of minute amounts. In the plunger pump, liquid is supplied through extrusion and suction of a cylinder and on-off (open-and-close) movement of a valve and plunger pumps different in mechanism include a ceramic pump, a glass metering pump, a medium-pressure liquid supply pump and a high-pressure liquid supply pump. Specifically, the ceramic pump, which has no valve mechanism and is not likely to cause lowering in liquid supply due to clogging or galling is preferable. The tube pump is a pump, in which liquid is continuously supplied by compressing an elastic tube under a rotating roller, and it is preferred in terms of no clogging or leakage occurred due to sealing or valves and only the tube being in contact with the liquid. The tube pump is typically classified into a cassette tube pump, roller tube pump and panel roller pump, in terms of manner of compressing the tube, and a cassette tube pump, micro-tube pump and panel tube pump are preferred in terms of liquid-supplying rate and stability.

The rate of supplying a processing solution (liquid flow rate) refers to the amount (flow rate) of processing solution that is supplied to the discharge orifice by a metering pump or the like, and fluctuation per second is preferably within ±10%.

The processing solution-supplying means used in the invention is expected to be used over a period of some years and therefore sufficient durability is needed. Tubes employed in the tube pump include, for example, a pullulan tube, a Tygon Tube (available from Norton Co.), a silicone tube and a PharMed Tube (available from Norton Co.). Of these, a firmed tube is preferred in terms of high durability and low oxygen permeability.

The electromagnetic metering pump is a diaphragm system employing volume change, in which a continuous liquid supply can be achieved by increasing the pump stroke number, and which is also preferably used in the invention. The gear pump is a system of supplying liquid by movement of a fine ceramic gear, in which constant liquid supply is feasible irrespective of physical properties of the liquid (such as surface tension or viscosity), and it is also preferably used in the invention.

These pumps are commercially available, for example, from TOKYO RIKAKIKAI Co., Ltd. and IWAKI PUMP CO., Ltd. Further, the combination of these systems with open-and-close of the flow route by means of a electromagnetic valve is more preferred.

In the invention, it is preferred to adopt the weight-applying speed control system, in which applying a given pressure within a closed tank, a flow rate-controlling means is provided on the passage to an exit or coating solution-discharging orifice (also called processing solution-supplying orifice) of the tank, while applying a given pressure within the closed tank. The flow rate is controlled preferably by providing an automatic needle orifice in the course of liquid-flow in the tube. Movement of the needle can be controlled by a stepping motor or the like. In this system, a processing tank is provided at a position higher than the coating solution-discharging orifice and liquid supply is conducted preferably by employing a difference in liquid level. It is also preferred to detect the difference in the liquid level by a sensor to control the flow rate in proportion to the difference in liquid level.

Examples of a system for supplying the processing solution to the coating section include a system described in JP-A No. 2-79839, FIG. 1, comprising a processing tank, processing solution-supplying tube, flow rate-control valve, closing valve and a section for supplying a coating solution to a photographic material (or processing solution-supplying orifice). Techniques for high-viscosity solution coating include, for example, methods of supplying, coating or transferring viscous fluid material, as described in JP-A Nos. 2000-93867, 11-189228 and 5-171562, but are not specifically limited to these methods.

Processing Solution Viscosity

One aspect of the invention is that the rate of supplying the processing solution to the processing solution-supplying orifice of the coating section (liquid flow rate), i.e., the rate for supplying the solution to the coating section, is within the range of 0.002 to 2.0 ml/sec, and preferably 0.03 to 1.5 ml/sec; and the viscosity of the supplied processing solution is 10.1 to 15000 centi-poise (cp) at 25° C., preferably 15 to 3000 cp, and more preferably 20 to 1000 cp.

Techniques for controlling the viscosity include, for example, allowing a water-soluble polymer to be contained within a range having no adverse effect on processability, controlling a salt concentration within an optimal range having no adverse effect on processability and allowing a hydrophilic solvent to be contained within a range having no adverse effect on processability, but are not specifically limited to these techniques. Examples of the water-soluble polymer usable in the invention include vinyl polymers or their derivatives such as polyvinyl alcohols, polyvinyl pyrrolidones, polyvinyl pyridinium halide and various modified polyvinyl alcohols; acryl group containing polymers such as polyacrylamide, polydimethylaminoacrylate, poly (sodium acrylate), acrylic acid-methacrylic acid copolymer salt, poly(sodium methacrylate), acrylic acid-vinyl alcohol copolymer salt; natural polymeric materials and their derivatives such as starch, oxidized starch, carboxylated starch, dialdehyde gelatin, cationic gelatin, dextrin, sodium alginate, Arabic gum, casein, pullulan, dextran, methyl cellulose, ethyl cellulose, carboxymethyl cellulose, and hydroxypropyl cellulose; and synthetic polymers such as polyethylene glycol, polypropylene glycol, polyvinyl ether, polyglycerine, maleic acid-alkyl vinyl ether copolymer, maleic acid-N-vinylpyrrole copolymer, styrene-anhydrous maleic acid copolymer and polyethyleneimine. Of these polymers, polyvinyl pyrrolidones, polyvinyl alcohols and polyalkyleneoxides are preferable.

Developing Agent

The color developing agent refers to a compound capable of oxidizing silver halide having a latent image and becoming an oxidized product, which reacts with a coupler to form a dye. Examples of the color developing agent include compounds (C-1) through (C-16) described in JP-A No. 4-86741 at page 7 to 9; compounds (1) through (8) described in JP-A No. 61-289350 at page 29 to 31; compounds (1) through (62) described in JP-A No. 3-246543 at page 5 to 9; exemplified compounds (C-1) and (C-3) described in JP-A No. 4-86741; exemplified compound (2) described in JP-A No. 61-289350; exemplified compound (1) described in JP-A No. 3-246543; sulfonamidophenol type color developing agents represented by formula (8) through (12) described in JP-A No. 2001-154325; sulfonamidoaniline type color developing agents and hydrazine type color developing agents. In addition thereto are also usable precursors of a p-phenylenediamine type color developing agent represented by formulas (1) through (6) described in JP-A Nos. 5-241305 and 11-167185 and Japanese Patent Application No. 11-358973. Of these, p-phenylenediamine type color developing agents are preferably used to efficiently achieve the objects of the invention and compounds having water-solubilizing group (i.e., a group promoting solubility in water) such as a hydroxy group or sulfonyl group are preferably used.

Developing Agent Concentration and Distance Between Coating Section and Photographic Material In one preferred embodiment of the invention, the concentration of a color developing agent in the processing solution is 40 to 200 mmol/1000 ml and the coating section is arranged apart from the photographic material so that a spacing between the coating section and the photographic material is maintained at 0.8 to 15 times a total dry layer thickness of the photographic material. In this case, the spacing between the coating section and the photographic material refers to the closest distance between the photographic material and the supplying site of the processing solution onto the photographic material. In cases where the coating section is provided with a coating means such as a roller, for example, the spacing between the coating section and the photographic material is to be the closest distance between the roller and photographic material. In cases where the coating section has an orifice for supplying the processing solution to the photographic material, the spacing is to be the closest distance between the orifice and photographic material. Herein, the total dry layer thickness refers to the thickness of total layer(s) provided on the emulsion layer side of the support of the photographic material, however, this dry layer thickness is not to include the thickness of the support. Thus, the dry layer thickness not including the support thickness refers to the thickness of total layers, such as a sublayer, interlayer, a light-sensitive emulsion layer and protective layer, all of which are provided on the emulsion layer side of the support. The dry layer thickness can be determined in such a manner that the photographic material is cut vertically to the support surface using a microtome to prepare a slice and the cross-section of the obtained slice is observed with an optical microscope. In the case of using two or more kinds of color developing agents in combination, the developing agent concentration in the invention is the total value of respective developing agents.

In a further preferred embodiment of the invention, the concentration of a color developing agent is 70 to 200 mmol/1000 ml and the distance between the supplying orifice and the photographic material is maintained within the range of 1.5 to 10 times the dry layer thickness. The processing solution-supplying orifice may be in a multi-hole or slit form and the slit form is preferred in the invention.

Processing Solution pH

In one preferred embodiment of the invention, the processing solution exhibits a viscosity of 10.1 to 15000 cp at 25° C. and a pH o 10.3 to 14.0. In the invention, pH-adjusting agents for a developer solution include, for example, potassium carbonate, sodium carbonate, potassium hydroxide, potassium phosphate, potassium hydrogen carbonate, and sodium hydroxide. Further, examples of a pH buffering agent include sodium carbonate, potassium carbonate, sodium bicarbonate, potassium bicarbonate, trisodium phosphate, tripotassium phosphate, dipotassium phosphate, sodium borate, potassium borate, sodium tetraborate, potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfosalicylate). The pH of the processing solution is preferably 10.5 to 13.3.

Maximum Water Absorption Amount

In the invention, the maximum water absorption amount of the photographic material is defined as follows. Thus, 100 $cm^2$ of a photographic material sample, in which the non-emulsion layer side (opposite of the emulsion layer side, including a back layer of a backing coat) was previously subjected a water-proofing treatment using a water-proof tape, is weighed (weight 1). Subsequently, the photographic material sample is immersed into deionized water of 25° C. for 10 min. and after wiping off extraneous water on both surfaces of the sample, the sample is weighed again (weight 2). This procedure is repeated five times and the average value of differences between weight 1 and weight 2 (i.e., weight 2 minus weight 1) is defined as the maximum water absorption amount.

Processing Part Solution

In one preferred embodiment of the invention, the processing solution is comprised of at least two part solutions. Thus, the processing solution is supplied in the form of being comprised of at least two part solutions, which are mixed immediately before processing. Plural concentrated processing solutions, for example, are supplied and mixed on the surface of the photographic material, thereby forming a single processing solution having an extremely high concentration and achieving sufficient effects of the invention. During the storage or before coating, the processing solution is in the form of being separated to at least two part solutions, which are mixed on the surface of the photographic material or within the processing solution-supplying means or processing solution-supplying apparatus. For example, a developing solution preferably comprises a first part-solution containing a developing agent and a second part-solution containing an alkali component. Color developing agents of afore-mentioned p-phenylenediamine derivatives and hydrazine derivatives are used as a preferred color developing agent.

Two part-solutions can be mixed immediately before being mixed, for example, by employing an apparatus described in U.S. Pat. No. 5,698,382 and JP-A No. 11-65054. Three or more part-solutions may be used, which may be simultaneously mixed, or two of which may be mixed in advance, followed by mixing the other solution(s). The part-solutions may be mixed on the photographic material surface. Alternatively, the part-solutions may be mixed and then supplied to the processing solution-supplying orifice.

Squeezing

The photographic material, after being developed, is preferably subjected to a squeezing treatment. The squeezing treatment refers to allowing a photographic material to pass between a pair of squeeze rollers, while being interposed between the rollers. Water-absorptive sponge roller or slightly water-absorptive rollers can be used as the squeeze roller; and a metal (such as stainless steel) roller, plastic resin roller, rubber roller, fabric roller, non-fabric roller and sintered body roller are usable. Materials of the metal roller include, for example, stainless steel (e.g., SUS316L, SUS316, SUS304, SUS303, etc.), titanium (Ti) and brass (Bs). Plastic resins for the plastic resin rollers include, for example, polyethylene terephthalate (PET), polyethylene (PE), tetrafluoroethylene-fluoroalkoxyethylene copolymer (PFA), polyacetal (POM), polypropylene (PP), polytetrafluoroethylene (PTFE), polyvinyl chloride (PVC), phenol resin (PF), modified polyphenylene ether (PPE), modified polyphenyleneoxide (PPO), polyurethane (PU), polycarbonate (PC), polyphenylene sulfide (PPS), polyfluorovinilidene (PVDF), and tetrafluoroetylene-ethylene copolymer (ETFE). Material for fabric and non-fabric rollers include, for example, polyolefin type fiber, polyester type fiber, polyacrylonitrile type fiber, aliphatic polyamide type fiber-aromatic polyamide type fiber and polyphenylene sulfide type fiber. Furthermore, Teflon-coated rollers are more preferable.

The squeezing treatment used in the invention can be applied to any stage after completion of development and is applicable, for example, to the following process: Developing-Squeeging-Reading by an image sensor, Developing-Stopping-Squeeging-Reading by an image sensor, Developing-Squeeging-Stopping-Reading by an image sensor, Developing-Reading by an image sensor-Squeezing, and Developing-Stopping-Reading by an image sensor-Squeezing The squeezing treatment enables to adjust the amount of a processing solution provided onto the emulsion layer side of the photographic material, to remove an excessive processing solution, which may cause staining during transporting the photographic material or to enhance uniformity of the processing solution on the emulsion layer side of the photographic material.

Development Stop

The photographic material, after being developed, is preferably subjected to a development stop treatment (hereinafter, also denoted as a development stopping treatment or simply as stopping). In the invention, the development stop treatment refers to a process of providing an acid onto the photographic material, a process of providing a development inhibitor to the photographic material, a process of providing a compound capable of deactivating a color developing agent onto the photographic material or a process of providing a compound capable of oxidizing developed silver onto the photographic material, after completion of development. Exemplary examples thereof include providing onto the photographic material organic acids such as acetic acid, citric acid or oxalic acid, or inorganic acids such as hydrochloric acid, sulfuric acid or nitric acid; providing a development inhibitor such as a mercapto group-containing compound, azoles or halogen to the photographic material; providing a compound capable of deactivating a color developing agent or its oxidation product, such as citrazinic acid, sulfinic acid, a non-dye-forming coupler or a sulfite onto the photographic material; and providing a compound capable oxidizing developed silver such as ferric ethylenediaminetetraacetate or ferric propylenediaminetetraacetate onto the photographic material.

Thermal Development

In one preferred embodiment of the invention, development is performed at a temperature of 43 to 950° C. This thermal development may be carried out by directly heating the photographic material or by heating the processing solution, and heating the processing solution is preferred in terms of process stability. The developing temperature of a photographic material heated by a heating means is preferably not less than 45° C., and more preferably not less than 50° C. Further, the developing temperature is preferably not more than 85° C., and more preferably not more than 80° C. in terms of heat resistance of the photographic material or control easiness of the processing. Means for heating a photographic material include, for example, a conduction heating means in which a photographic material is brought into contact with a heated drum or heated belt and is heated through thermal conduction; a convection heating means of heating through convection using a dryer or the like; and a radiation heating means of heating through radiation of infrared rays or high frequency electromagnetic waves. In the conduction heating, a heat source is preferably in contact with the back-side of the photographic material to avoid adverse effects on the photographic material. Further, in cases when the photographic material is heated before the processing solution is supplied, to minimize influences caused by difference in sensitivity due to the temperature during exposure, it is preferred to heat the photographic material after completion of exposure.

When the photographic material exists in preference to a heating means, it is preferred to provide a means for controlling heating (heat-controlling means) to prevent unnecessary heating. This is comprised of a means for controlling so as to cause a heating means to start heating after a predetermined time, based on development-starting action or information, a means for transporting a photographic material at a prescribed speed (a transport means) and a means for detecting the photographic material which is provided at the prescribed position upstream of the transporting direction of the transport means, in preference to the heating means (detecting means), and heat-controlling can be achieved by causing the heat-controlling means to control heating, based on detection by the detecting means. In this regard, it is preferred that heating is controlled so that the heating means performs the prescribed heating from the time when a given time has elapsed after the detecting means detected an absence to presence of a photographic material at the prescribed position to the time when a given time has elapsed after the detecting means detected the presence to absence of the photographic material.

Reading by Image Sensor, Light Source Intensity and Treatment After Reading

An image sensor used in this invention, such as a scanner is an apparatus for converting reflection or transmission density obtained by optically scanning a processed photographic material to image information. Scanning the processed photographic material is generally or preferably conducted in such a way that the optical portion of a scanner is allowed to move in a different direction from the moving direction of the processed photographic material. However, the processed photographic material may be fixed and the optical portion of the scanner alone may move; alternatively, the optical portion of the scanner may be fixed and the processed photographic material alone may move. Any combination thereof may also be acceptable. Image information of the processed photographic material is preferably read in such a manner that at least three lights of different wavelengths, each of which is within the wavelength region of dye absorption, are irradiated overall or by scanning through a slit to measure the reflected or transmitted light. In this case, diffused light, rather than specular light is more preferable to remove information due to a matting agent or flaws. A semiconductor image sensor (e.g., area-type CCD, CCD line-sensor, etc.) is preferably employed in the receptor section. A processing element may or may not exist in image reading. As the area-type image sensor are preferred a color sensor having a Bayer-type color filter arrangement and a monochromatic sensor having a color separation mechanism of a filter rotating turret housing RGB color filters. The area-type sensor preferably contains a cell having six millions or more effective pixels.

In the invention, a light source used in an image sensor such as a scanner preferably has an output of 100 W or more. Preferred light sources include, for example, a metal halide lamp, xenon flash, and halogen lamp. There are also cited halogen lamp, JCR series (such as JCR-12V-50WG, JCR-15V-150W), metal halide lamp, UMI series and UMD series, and xenon flash, FQ502, FQ440 and FG370, each of which is available from USHIO DENKI Co., Ltd. In addition thereto, a halogen light source apparatus, LA-150UX (180W, available from HAYASHI TOKEI-KOGYO Co., Ltd.) is also cited as a light source for an image sensor.

In cases where an infrared light is used as a light source for reading with an image sensor such as a scanner, there can be obtained image information being present in the photographic material and not related to absorption in the visible light region. Such image information of the infrared light can be used for correction of image faults, for example, according to the method described in U.S. Pat. No. 5,266,805.

In the invention, the thus read image signals can be outputted to form images on another recording material or to be memorized in another storage medium. Alternatively, the read image signals may be subjected to various image processing methods, such as a chroma-enhancing treatment which makes a stroke correction of the read image signals in accordance with the developed silver amount, or the foregoing infrared image processing.

Outputting may be done by conventional projection exposure, or image information which is photoelectrically read by transmission densitometry may be outputted by the signals. Material to be outputted may not only be a photographic material but may also be a sublimation type thermographic material, ink-jet recording material or full color direct thermographic recording material. In one preferred embodiment of the invention, after forming color images by thermal development, regardless of whether an additional treatment for removing remained silver halide and developed silver is carried out or not, image information is read by transmission densitometry using diffused light and a CCD image sensor, transformed into digital signals, subjected to image processing, and outputted onto an ink-jet recording material. The digital signals can be arbitrarily converted or edited so that photographed images can be freely corrected, changed or converted to be outputted.

In one preferred embodiment of the invention, after development, image information formed on the photographic material is read by an image sensor and then subjected to at least one selected from bleaching, fixing and stopping treatments. Bleaching and fixing treatments used in the invention are, for example those included in Process C-41 described earlier and bleach-fixing is also included. Conducting the foregoing treatments after completion of development is intended to (i) enhance safety in handling a photographic material by lowering a pH of the photographic material, and (ii) to add reusability for reading by a scanner, due to enhanced image storage stability of a photographic material subjected to reading by an image sensor.

In still another preferred embodiment of the invention, when reading image information by an image sensor such as scanner, the coating weight of a processing solution on the light-sensitive layer side of the photographic material is to be within the range of 0.2 to 40 times (and more preferably 0.3 to 20 times) the maximum water absorption amount thereof. It is contemplated to be due to the fact that flatness of the surface to be read by an image sensor such as scanner is superior in a wetted photographic material rather than in a dried photographic material. In the invention, the coating weight of the processing solution is defined as follows. Thus, after being allowed to stand in an atmosphere of 23° C. and 55% RH for 24 hrs and before having been coated with a processing solution, 100 $cm^2$ of the photographic material is weighed (weight-3, expressed in "g"). Further, after coating the processing solution onto the photographic material to perform development, the photographic material at the time when reading image information by an image sensor is again weighed for 100 $cm^2$ (weight-4, expressed in "g") and then the difference between weight-3 and weight-4 (i.e., weight-4 minus weight-3) is determined. This procedure is repeated five times and the average value of the differences is defined as the coating weight of the processing solution in the invention (expressed in g).

Photographic Material

Any appropriate system is applicable for the photographic materials used in the invention, such as a system of forming color through color development with a coupler, a system of color formation by oxidation of leuco dyes, and a system of having a color filter layer and a silver halide layer and obtaining color images without color development.

The photographic material relating to the invention preferably comprises at least a red-sensitive silver halide emulsion layer, green-sensitive silver halide emulsion layer and a blue-sensitive silver halide emulsion layer to record red, green and blue light.

In the photographic materials relating to the invention are usable silver halide emulsions described in Research Disclosure NO. 308119 (hereinafter, also denoted simply as RD308119). Relevant portions are shown below.

| Item | RD 308119 |
|---|---|
| Iodide composition | 993, I-A |
| Preparation method | 993, I-A; 994, I-E |
| Crystal habit (regular crystal) | 993, I-A |
| Crystal habit (twinned crystal) | 993, I-A |
| Epitaxial | 993, I-A |

-continued

| Item | RD 308119 |
|---|---|
| Homogeneous halide composition | 993, I-B |
| Inhomogeneous halide composition | 993, I-B |
| Halide conversion | 994, I-C |
| Halide substitution | 994, I-C |
| Metal occlusion | 994, I-D |
| Monodispersibility | 995, I-F |
| Solvent addition | 995, I-F |
| Latent image forming site (surface) | 995, I-G |
| Latent image forming site (internal) | 995, I-G |
| Photographic material (negative) | 995, I-H |
| Photographic material (positive, including internally fogged grains) | 995, I-H |
| Emulsion blending | 995, I-I |
| Desalting | 995, II-A |

Silver halide emulsions according to the invention are subjected to physical ripening, chemical ripening and spectral sensitization. As additives used in these processes are shown compounds described in Research Disclosure No. 17643, No. 18716 and No. 308119 (hereinafter, denoted as RD 17643, RD 18716 and RD 308119), as below.

| Item | RD 308119 | RD 17643 | RD 18716 |
|---|---|---|---|
| Chemical Sensitizer | 996, III-A | 23 | 648 |
| Spectral Sensitizer | 996, IV-A-A,B,C, D,H,I,J | 23–24 | 648–9 |
| Super Sensitizer | 996, IV-A-E, J | 23–24 | 648–9 |
| Antifoggant | 998, VI | 24–25 | 649 |
| Stabilizer | 998, VI | 24–25 | 649 |

Photographic additives usable in the invention are also described, as shown below.

| Item | RD 308119 | RD 17643 | RD 18716 |
|---|---|---|---|
| Anti-staining Agent | 1002, VII-I | 25 | 650 |
| Dye Image-Stabilizer | 1001, VII-J | 25 | |
| Britening Agent | 998, V | 24 | |
| U.V. Absorbent | 1003, VIII-I, XIII-C | 25–26 | |
| Light Absorbent | 1003, VIII | 25–26 | |
| Light-Scattering Agent | 1003, VIII | | |
| Filter Dye | 1003, VIII | 25–26 | |
| Binder | 1003, IX | 26 | 651 |
| Anti-Static Agent | 1006, XIII | 27 | 650 |
| Hardener | 1004, X | 26 | 651 |
| Plasticizer | 1006, XII | 27 | 650 |
| Lubricant | 1006, XII | 27 | 650 |
| Surfactant, Coating aid | 1005, XI | 26–27 | 650 |
| Matting Agent | 1007, XVI | | |
| Developing Agent (incorporated in photographic material) | 1001, XXB | | |

A variety of couplers can be employed in the invention and examples thereof are described in research Disclosures described above. Relevant description portions are shown below.

| Item | RD 308119 | RD 17643 |
|---|---|---|
| Yellow coupler | 1001, VII-D | VII-C~G |
| Magenta coupler | 1001, VII-D | VII-C~G |
| Cyan coupler | 1001, VII-D | VII-C~G |
| Colored coupler | 1002, VII-G | VII-G |
| DIR coupler | 1001, VII-F | VII-F |
| BAR coupler | 1002, VII-F | |
| PUG releasing coupler | 1001, VII-F | |
| Alkali-soluble coupler | 1001, VII-E | |

Additives used in the invention can be added by dispersion techniques described in RD 308119 XIV. In the invention are employed supports described in RD 17643, page 28; RD 18716, page 647-648; and RD 308119 XIX. In the photographic material relating to the invention, there can be provided auxiliary layers such as a filter layer and interlayer, as described in RD 308119 VII-K, and arranged in a variety of layer orders such as normal layer order, reverse layer order and a unit layer arrangement.

Film Form

In cases when the photographic material relating to the invention is used in a roll form, it is preferred to adopt a form of housing it in a cartridge. The cartridge that is most popular at the present time is a 135 format or IX-240 format cartridge. There are also usable cartridges proposed in Japanese Utility Model Application No. 58-67329; JP-A Nos. 58-181835, 58-182634; Japanese Utility Model Application No. 58-195236; U.S. Pat. No. 4,221,479; Japanese Patent Application Nos. 63-57785, 63-183344, 63-325638, 1-21862, 1-25362, 1-30246, 1-20222, 1-218631-37181, 1-33108, 1-851981, 1-172595, 1-172594, 1-172593; and U.S. Pat. Nos. 4,846,418, 4,848,693 and 4,832,275.

Next, film cartridges housing photographic material will be described. The main material of cartridges used in the invention may be metals or synthetic plastic resins. Preferred examples of plastic resin material include polystyrene, polypropylene and polyphenyl ether. The cartridge may contain various antistatic agents; and carbon black, metal oxide particles, nonionic, anionic, cationic or betaine-type surfactants are preferable. Static-free cartridges are described in JP-A 1-312537 and 1-312538 and those which exhibit a resistance of 1012 Ω or less at 25° C. and 25% RH are specifically preferred. Conventionally used plastic resin cartridges are made by compounding carbon black or pigments for light-tightness. The cartridge size may be the same as the present 135-size. Alternatively, to make the camera format still smaller, it is useful to make the 25 mm cartridge diameter of the present 135-size 22 mm or less. The volume of the cartridge case is preferably not more than 30 $cm^3$, and more preferably not more than 25 $cm^3$. The weight of plastic resin used in the cartridge or its case is preferably 5 to 15 g. A cartridge in which film is delivered by a rotating spur is also usable. A structure is also feasible, in which the top of the film is housed within a cartridge and the film top is delivered from the port portion of the cartridge to the outside by rotating the spur shaft in the direction of film delivery. These are disclosed in U.S. Pat. Nos. 4,834,306 and 5,226,613.

The photographic material relating to the invention may be housed in a commercially available lens-fitted film unit. It is also preferable to load the photographic material into the lens-fitted film unit described in Japanese Patent Application Nos. 10158427, 10-170624 and 10-188984.

Figure 2:
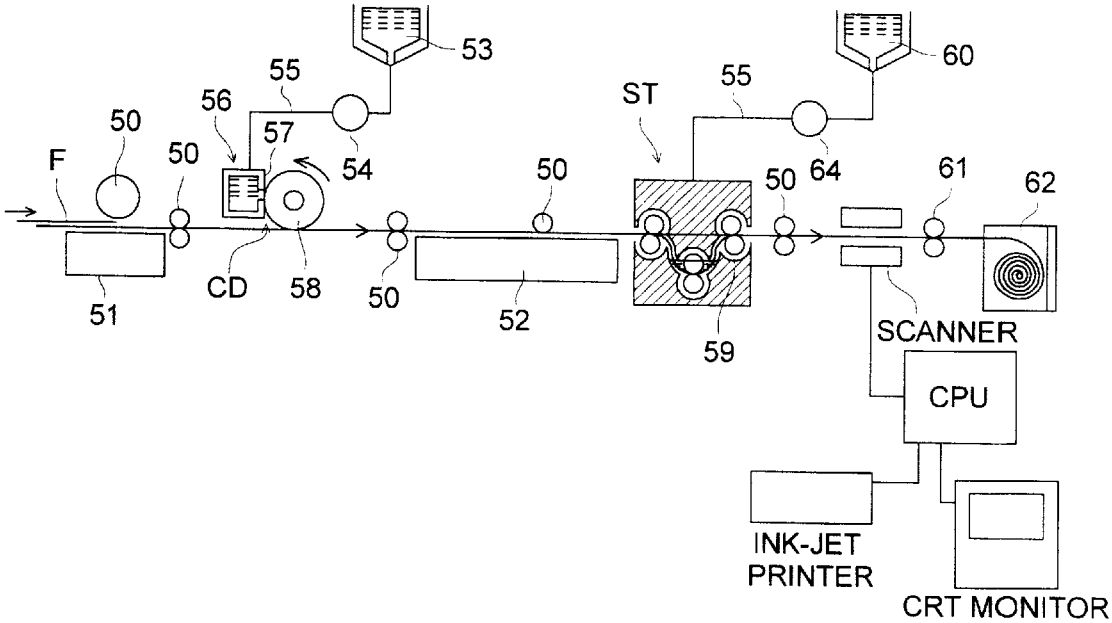
FIG. 2 also illustrates an example of a processing apparatus and image forming apparatus used in the image formation process according to the invention.

FIG. 1 illustrates an example of a processing apparatus used in the image formation process according to the invention. FIG. 2 also illustrates an example of a processing apparatus and image forming apparatus used in the image formation process according to the invention. In the developing step (CD) of the processing apparatus shown in FIG. 1 or 2, a transport route to transport photographic material (F) by plural transport means (50) is formed and the photographic material is transported with the emulsion layer side upward. In the transport route to transport the photographic material (F), a first heating means (51) and a second heating means (52) are arranged in this order in the transportation direction. In the processing solution-supplying section, a supply means (56) for a processing solution (color developing solution), which is arranged above the transport route has a nozzle (57) to supply the processing solution to a coating section. The processing solution (color developing solution) is supplied from a replenisher tank (53) to the supply means (56) over the supplying route (55) using a pump (54) and is further supplied through the nozzle (57) to a coating roller (58), then, the color developing solution is supplied to the photographic material (F) for coating by the coating roller (58).

In FIG. 2, a subsequent stopping step (ST) is provided, processing solution (stop solution) arranged over the transport route is supplied from a replenisher tank (60) to a small stop solution tank (59) through supplying route (55) using pump (54) to perform stopping of the photographic material. A squeeze roller (61) may optionally be provided to squeeze the developed photographic material. Further, after having been subjected to reading by an image sensor, the photographic material may be taken up onto a recovering section (62) to recycle it for its resources.

Subsequently after the developing step (CD), as shown in FIGS. 1 and 2, or after stopping step (ST), as shown in FIG. 2, image information of the photographic material is read using a scanner for a negative film (e.g., Duo Scan, produced by Agfa Co. and transferred to a personal computer (e.g., FMV-DESK POWE TII20D RAM128M-extended, available from FUJITSU ITD.) using SCSI as an interface (e.g., AHA-2940AU, available from Adaptec Co.) and the obtained digital information, after having been subjected to image processing, is outputted using an ink-jet printer (e.g., PM-700C., available from SEIKO-EPSON Co.)

Figure 3:
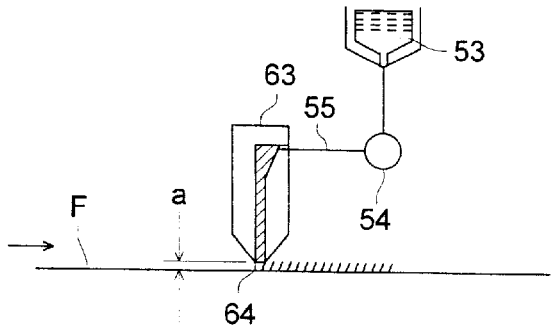
FIG. 3 illustrates a coating system using a coating section having a coating solution-supplying orifice.

FIG. 3 shows a coating system using a slot coater (63) having a coating solution-supplying orifice (64), in place of using the coating roller (58) shown in FIGS. 1 and 2, wherein "a" represents the distance between the supplying orifice (64) and the photographic material (F).

EXAMPLES

The present invention will be further described, based on examples, but the invention is by no means limited to these embodiments.

Example 1

Preparation of Photographic Material Sample 101

The following layers containing composition as shown below were formed on a subbed triacetyl cellulose film support to prepare a photographic material Sample 101. The addition amount of each compound was represented in term of $g/m^2$, provided that the amount of silver halide or colloidal silver was converted to the silver amount and the amount of a sensitizing dye (denoted as "SD") was represented in mol per mol of silver halide contained in the same layer.

| | |
|---|---|
| 1st Layer: Anti-Halation Layer | |
| Black colloidal silver | 0.20 |
| UV-1 | 0.30 |
| CM-1 | 0.040 |
| OIL-1 | 0.167 |
| Gelatin | 1.33 |
| 2nd Layer: Intermediate Layer | |
| CM-1 | 0.10 |
| OIL-1 | 0.06 |
| Gelatin | 0.67 |
| 3rd Layer: Low-speed Red-Sensitive Layer | |
| Silver iodobromide emulsion a | 0.298 |
| Silver iodobromide emulsion b | 0.160 |
| SD-1 | $2.4 \times 10^{-5}$ |
| SD-2 | $9.6 \times 10^{-5}$ |
| SD-3 | $2.0 \times 10^{-4}$ |
| SD-4 | $8.9 \times 10^{-5}$ |
| SD-5 | $9.2 \times 10^{-5}$ |
| C-1 | 0.56 |
| CC-1 | 0.046 |
| OIL-2 | 0.35 |
| AS-2 | 0.001 |
| Gelatin | 1.35 |
| 4th Layer: Medium-speed Red-sensitive Layer | |
| Silver iodobromide emulsion c | 0.314 |
| Silver iodobromide emulsion d | 0.157 |
| SD-1 | $2.5 \times 10^{-5}$ |
| SD-2 | $5.6 \times 10^{-5}$ |
| SD-3 | $1.2 \times 10^{-4}$ |
| SD-4 | $2.0 \times 10^{-4}$ |
| SD-5 | $2.2 \times 10^{-4}$ |
| C-1 | 0.36 |
| CC-1 | 0.052 |
| DI-1 | 0.022 |
| OIL-2 | 0.22 |
| AS-2 | 0.001 |
| Gelatin | 0.82 |
| 5th Layer: High-speed Red-Sensitive Layer | |
| Silver iodobromide emulsion c | 0.094 |
| Silver iodobromide emulsion d | 0.856 |
| SD-1 | $3.6 \times 10^{-5}$ |
| SD-4 | $2.5 \times 10^{-4}$ |
| SD-5 | $2.0 \times 10^{-4}$ |
| C-2 | 0.17 |
| C-3 | 0.088 |
| CC-1 | 0.041 |
| DI-4 | 0.012 |
| OIL-2 | 0.16 |
| AS-2 | 0.002 |
| Gelatin | 1.30 |
| 6th Layer: Intermediate Layer | |
| OIL-1 | 0.20 |
| AS-1 | 0.16 |
| Gelatin | 0.89 |
| 7th Layer: Low-speed Green-Sensitive Layer | |
| Silver iodobromide emulsion a | 0.19 |
| Silver iodobromide emulsion d | 0.19 |
| SD-6 | $1.2 \times 10^{-4}$ |
| SD-7 | $1.1 \times 10^{-4}$ |
| M-1 | 0.26 |
| CM-1 | 0.070 |
| OIL-1 | 0.35 |
| DI-2 | 0.007 |
| Gelatin | 1.10 |
| 8th Layer: Medium-speed Green-Sensitive Layer | |
| Silver iodobromide emulsion c | 0.41 |
| Silver iodobromide emulsion d | 0.19 |
| SD-6 | $7.5 \times 10^{-5}$ |
| SD-7 | $4.1 \times 10^{-4}$ |
| SD-8 | $3.0 \times 10^{-4}$ |
| SD-9 | $6.0 \times 10^{-5}$ |

-continued

| | |
|---|---|
| SD-10 | $3.9 \times 10^{-5}$ |
| M-1 | 0.05 |
| M-4 | 0.11 |
| CM-1 | 0.024 |
| CM-2 | 0.028 |
| DI-3 | 0.001 |
| DI-2 | 0.010 |
| OIL-1 | 0.22 |
| AS-2 | 0.001 |
| Gelatin | 0.80 |
| 9th Layer: High-speed Green-Sensitive Layer | |
| Silver iodobromide emulsion a | 0.028 |
| Silver iodobromide emulsion e | 0.49 |
| SD-6 | $5.5 \times 10^{-6}$ |
| SD-7 | $5.2 \times 10^{-5}$ |
| SD-8 | $4.3 \times 10^{-4}$ |
| SD-10 | $2.6 \times 10^{-5}$ |
| SD-11 | $1.3 \times 10^{-4}$ |
| M-1 | 0.068 |
| CM-2 | 0.015 |
| DI-3 | 0.029 |
| OIL-1 | 0.14 |
| OIL-3 | 0.13 |
| AS-2 | 0.001 |
| Gelatin | 1.00 |
| 10th Layer: Yellow Filter Layer | |
| Yellow colloidal silver | 0.06 |
| OIL-1 | 0.18 |
| AS-1 | 0.14 |
| Gelatin | 0.90 |
| 11th Layer: Low-speed Blue-sensitive Layer | |
| Silver iodobromide emulsion d | 0.11 |
| Silver iodobromide emulsion a | 0.15 |
| Silver iodobromide emulsion h | 0.11 |
| SD-12 | $1.0 \times 10^{-4}$ |
| SD-13 | $2.0 \times 10^{-4}$ |
| SD-14 | $1.6 \times 10^{-4}$ |
| SD-15 | $1.3 \times 10^{-4}$ |
| Y-1 | 0.71 |
| DI-3 | 0.016 |
| AS-2 | 0.001 |
| OIL-1 | 0.22 |
| Gelatin | 1.38 |
| 12th Layer: High-sped Blue-sensitive Layer | |
| Silver iodobromide emulsion h | 0.31 |
| Silver iodobromide emulsion i | 0.56 |
| SD-12 | $7.5 \times 10^{-5}$ |
| SD-15 | $4.0 \times 10^{-4}$ |
| Y-1 | 0.26 |
| DI-4 | 0.054 |
| AS-2 | 0.001 |
| OIL-1 | 0.13 |
| Gelatin | 1.06 |
| 13th Layer: First Protective Layer | |
| Silver iodobromide emulsion j | 0.20 |
| UV-1 | 0.11 |
| UV-2 | 0.055 |
| OIL-3 | 0.20 |
| Gelatin | 1.00 |
| 14th Layer: Second protective Layer | |
| PM-1 | 0.10 |
| PPM-2 | 0.018 |
| WAX-1 | 0.020 |
| SU-1 | 0.002 |
| SU-2 | 0.002 |
| Gelatin | 0.55 |

Characteristics of silver iodobromide emulsions described above are shown below, in which the average grain size refers to an edge length of a cube having the same volume as that of the grain.

| Emulsion No. | Av. grain size (μm) | Av. AgI content (mol %) | Diameter/thickness ratio | Coefficient of variation (%) |
|---|---|---|---|---|
| a | 0.27 | 2.0 | 1.0 | 15 |
| b | 0.42 | 4.0 | 1.0 | 17 |
| c | 0.56 | 3.8 | 4.5 | 25 |
| d | 0.38 | 8.0 | 1.0 | 15 |
| e | 0.87 | 3.8 | 5.0 | 21 |
| f | 0.30 | 1.9 | 6.4 | 25 |
| g | 0.44 | 3.5 | 5.5 | 25 |
| h | 0.60 | 7.7 | 3.0 | 18 |
| i | 1.00 | 7.6 | 4.0 | 15 |
| j | 0.05 | 2.0 | 1.0 | 30 |

With regard to the foregoing emulsions, except for emulsion j, after adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-3; a dispersing aid SU-4, viscosity-adjusting agent V-1, stabilizers ST-1 and ST-2; fog restrainer AF-1 and AF-2 comprising two kinds polyvinyl pyrrolidone of weight-averaged molecular weights of 10,000 and 1.100,000; inhibitors AF-3, AF-4 and AF-5; hardener H-1 and H-2; and antiseptic Ase-1.

Chemical structure for each of the compounds used in the foregoing sample are shown below.

Y-1

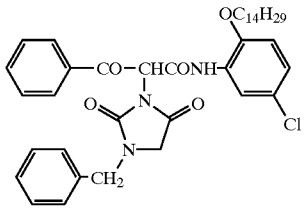

M-1

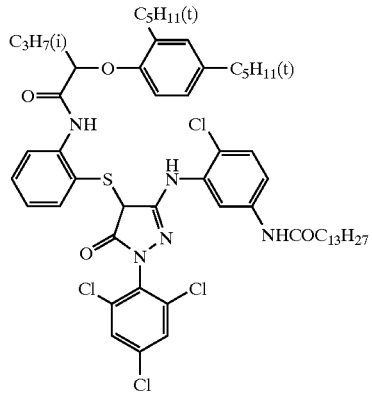

M-2

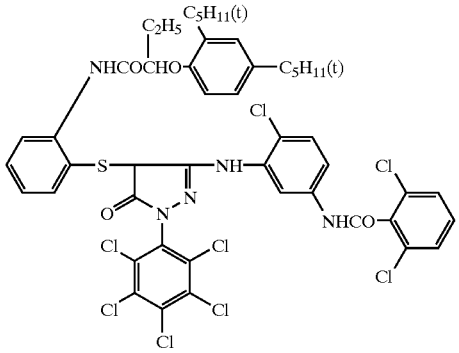

M-3

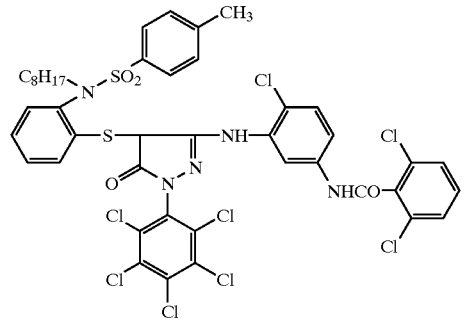

M-4

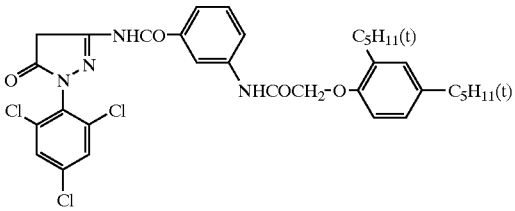

C-1

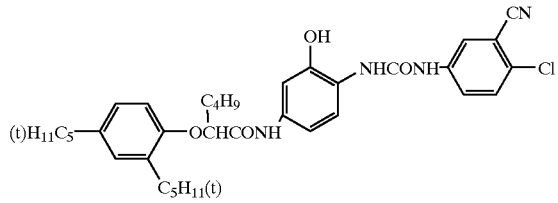

-continued
C-2
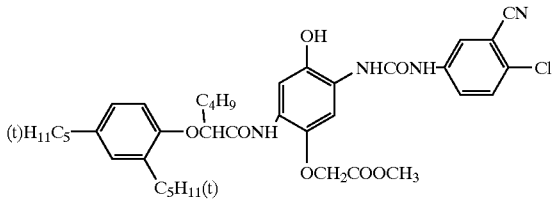
C-3
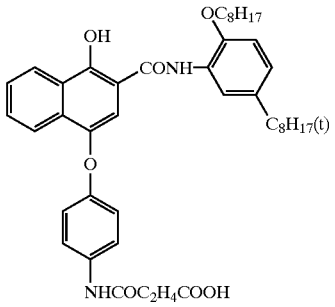
CC-1
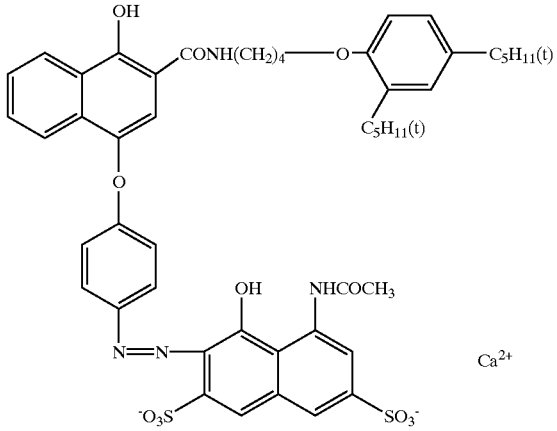
CM-1
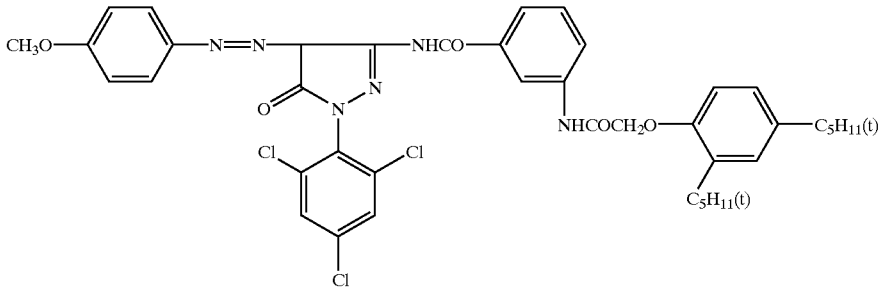
CM-2
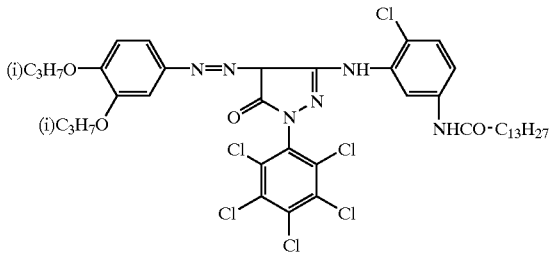
DI-1
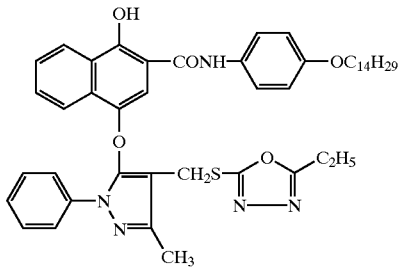

-continued
DI-2
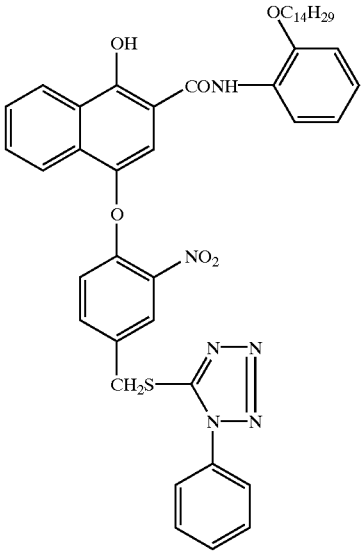
DI-3
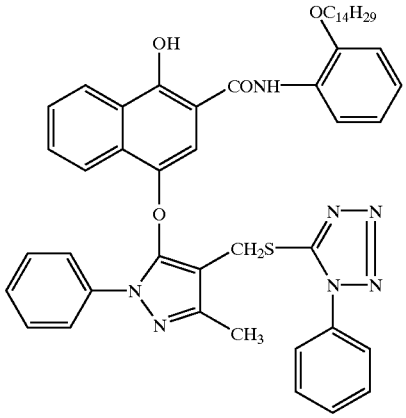
DI-4
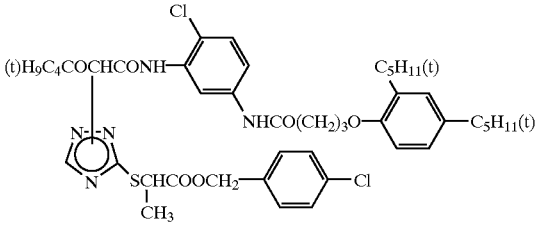
AS-1
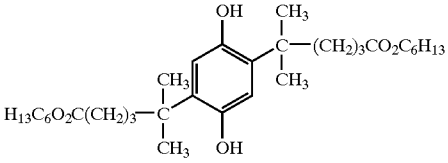
AS-2
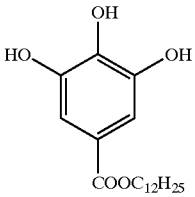
AS-3
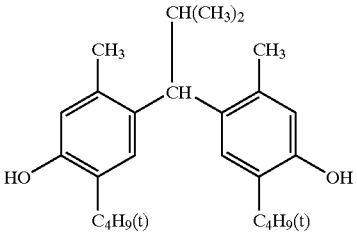
AS-4
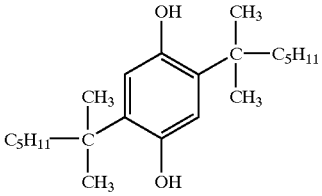
OIL-1
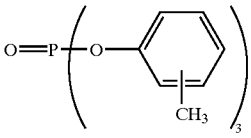
UV-1
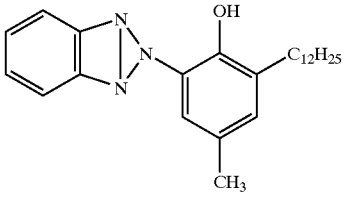
OIL-2
$H_9C_4OOC(CH_2)_8COOC_4H_9$
Liquid paraffin
OIL-3
UV-2
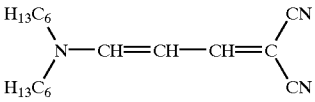

-continued
V-1
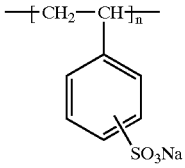
n: Degree of polymerization
Ase-1(Mixture)
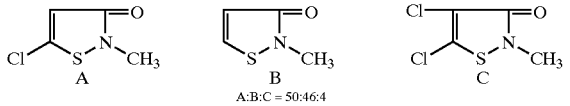
A:B:C = 50:46:4
H-1
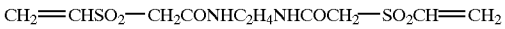
H-2
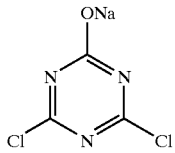
SD-1
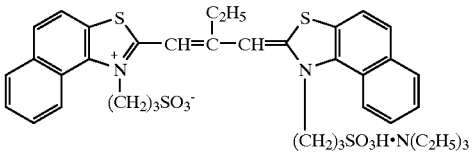
SD-2
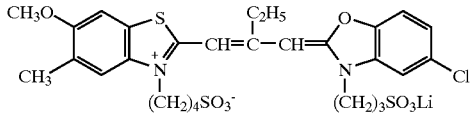
SD-3
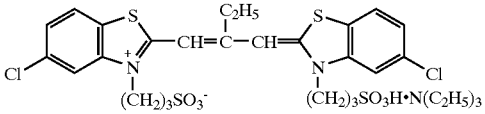
SD-4
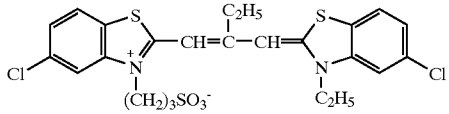
SD-5
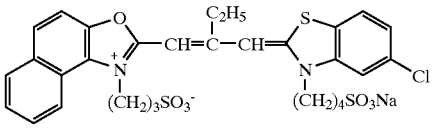
SD-6
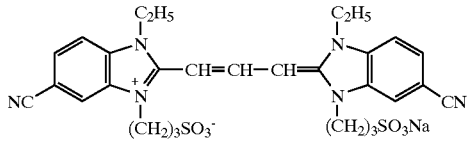
SD-7
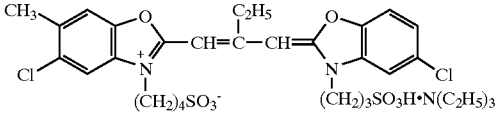
SD-8
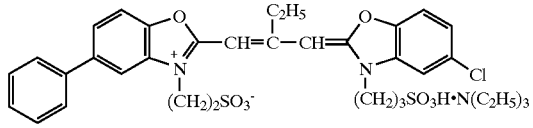
SD-9
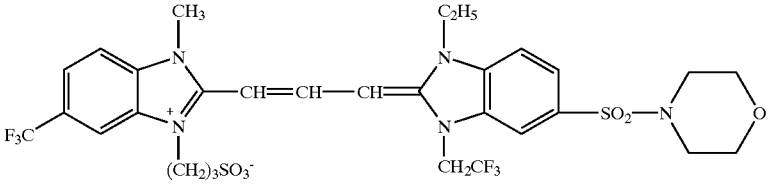
SD-10
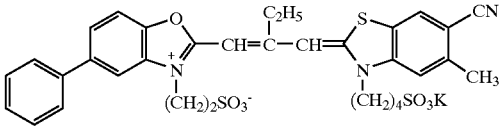
SD-11
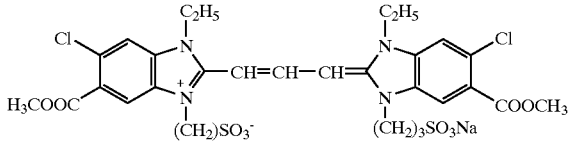
SD-12
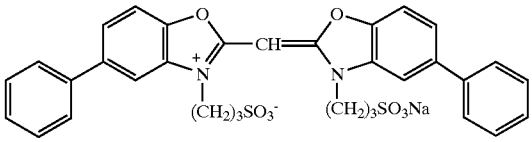
SD-13
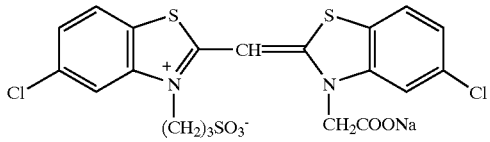

-continued

SD-14

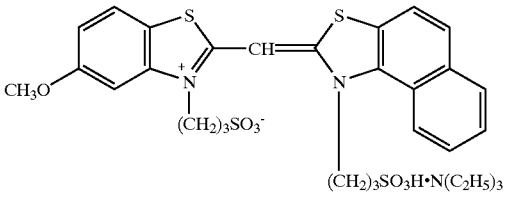

SD-15

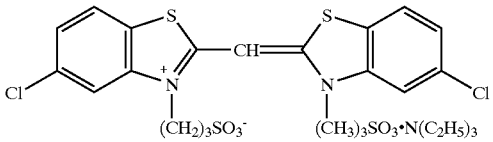

ST-1

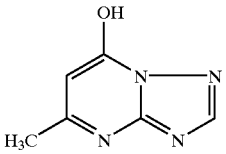

ST-2

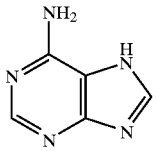

AF-1,2

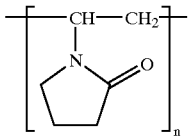

AF-1 Mw ≒ 10,000
AF-2 Mw ≒ 100,000
n: Degree of polymerization

AF-3

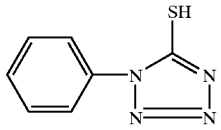

AF-4

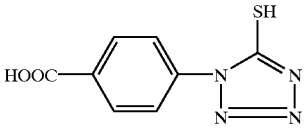

AF-5

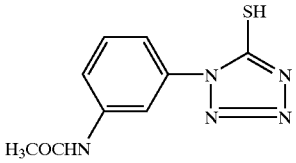

X-1

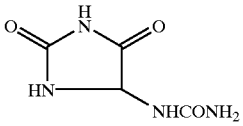

SU-1

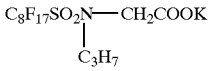

SU-2

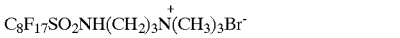

SU-3

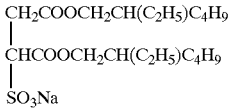

SU-4

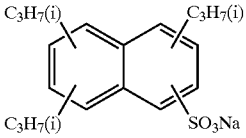

WAX-1

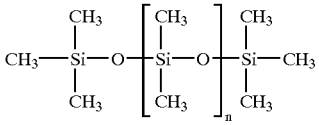

Mw = 3,000

PM-1

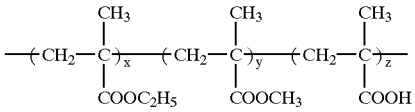

x:y:z = 3:3:4

PM-2

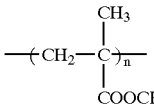

n: Degree of polymerization

The thus prepared photographic material sample was cut to a format of 135-size for use of 24 exposures and put into a film patrone and loaded into a camera (Big Mini NEO, available from Konica Corp.). Using this, test patterns were photographed to obtain exposed negative film.

The exposed sample was processed using the following processing solution and an apparatus, as shown in FIG. 1.

Process No. 1

| Step | Time | Temperature |
|---|---|---|
| Color Development (using CD solution) | 60 sec | 48° C. |

-continued

| Color developing solution: | CD solution (per liter) |
|---|---|
| Potassium carbonate | 160 g |
| Sodium hydrogen carbonate | 1.2 g |
| Pentasodium diethylenetriaminepentaacetate | 18 g |
| Sodium sulfite | 16 g |
| Hydroxylamine sulfate | 16 g |
| Potassium bromide | 1.2 g |
| 2-Methyl-4-(N-ethyl-N-(β-hydroxyethyl)-amino)aniline sulfate (CD-4) | 30 mmol |

Water was added to make 1 liter and the pH was adjusted to 10.0 with an aqueous 59% potassium hydroxide solution.

In the foregoing processing, the CD solution exhibited a viscosity of 1.3 centi-poise (cp) and the solution supplying amount to the supply section (56) was adjusted to 2.5 ml/sec using a bellows pump (54), as shown in FIG. 1. The ratio of a distance between a photographic material (F) and a closest portion of the coating roller (58) to the photographic material (i.e., the portion of supplying the CD solution to the photographic material) to a dry layer thickness of the photographic material (also denoted as gap ratio) was adjusted to 20.

After completion of development, samples each were dried so as to have a ratio of coating weight of processing solution to maximum water absorption amount of the photographic material of 0.16, and obtained images were printed on color print paper (QAA7 Paper, available from Konica Corp.) to obtain analog prints. The thus obtained prints were visually evaluated with respect to unevenness in processing, based on the criteria:

A (no unevenness observed), B (slight unevenness observed), and C (marked unevenness observed).

The red photographic material sample was cut to a format of 135-size for use of 24 exposure and put into a film patrone and loaded into a camera (Big Mini NEO, available from Konica Corp.). Using this camera, Macbeth colorchecker were continuously photographed for 100 shots.

Further, the foregoing processing was continuously conducted for 100 shot frames to evaluate the continuous process stability. Thus, transmission densitometry was carried out for a neutral color pattern portion in the colorchecker for each shot frame and representative color pattern portion having a transmission density near 1.00 was evaluated for each of 100 shot frames with respect to variation in density. When the average density for 100 shot frames was supposed to be 100%, the number of shot frames having a density of not more than 97% or a density of more than 103% was counted and evaluated as a measure of continuous process stability. The greater value indicates inferior stability in continuous processing.

Processing Nos. 2 to 16, each was run similarly to processing No. 1, except for conditions described below, and evaluation was also made similarly. Results thereof are shown in Table 1. As can be seen from Table 1, it was proved that the processing meeting the requirement of the invention led to an improvement in uniformity of processing and enhanced process stability, and thereby, effects of the invention ere confirmed.

Processing No. 2

The viscosity of the CD solution was adjusted to 30 cp.

Processing No. 3

The solution-supplying amount to the solution supply section was adjusted to 1.7 ml/sec.

Processing No. 4

The concentration of CD-4 of the CD solution was changed to 50 mmol/1 lit.

Processing No. 5

The gap ratio was adjusted to 2.0.

Processing No. 6

The pH of the CD solution was adjusted to 11.0.

Processing No. 7

The viscosity of the CD solution and the solution-supplying amount were adjusted to 27 cp and 0.6 ml/sec, respectively;

Processing No. 8

The concentration of CD-4 of the CD solution was adjusted to 120 mmol/1 lit.

Processing No. 9

The viscosity and pH of the CD solution were adjusted to 41 cp and 12.4, respectively.

Processing No. 10

The viscosity and pH of the CD solution were adjusted to 33 cp and 13.5, respectively, and the solution-supplying amount was adjusted to 0.8 ml/sec.

Processing No. 11

The viscosity, pH and CD-4 concentration of the CD solution were changed to 25 cp, 10.8 and 90 mmol/lit., respectively, the solution-supplying amount and gap ratio were adjusted to 1.2 ml/sec and 3.0, respectively.

Processing 12

CD-a solution was prepared similarly to CD solution of Processing 7, except that CD-4 was removed; separately, CD-b solution containing CD-4 of 30 mmol/lit. was prepared; and these two solutions were mixed on the way immediately before bellows pump (54) and supplied to the coating section. After mixing the two solutions, the viscosity and supplying amount were adjusted to 80 cp and 0.09 ml/sec, respectively.

Processing No. 13

The CD-4 concentration was changed to 150 mmol/lit. and the gap ratio was adjusted to 2.1, and squeezing was conducted at "50" between coating section of "58" and heating section of "52", as shown in FIG. 1.

Processing No. 14

The viscosity and pH of the CD solution were adjusted to 60 cp and 11.9, respectively; and after heating at "52", a development stop treatment was conducted by providing a 0.1N acetic acid solution to the photographic material using an apparatus, as designated by "59" in FIG. 2.

Processing No. 15

The viscosity and supplying amount of the CD solution were adjusted to 45 cp and 1.7 ml/sec, respectively; and the developing temperature was changed to 50° C.

Processing 16

The viscosity and pH of the CD solution were adjusted to 23 cp and 11,5, respectively; the developing temperature was changed to 480° C.; and the squeezing and development stop treatment were conducted similarly to Processing No. 13 and 14.

TABLE 1

| Processing No. | Unevenness in Process | Process Stability | Remark |
|---|---|---|---|
| 1 | B-C | 25 | Comp. |
| 2 | C | 23 | Comp. |
| 3 | C | 17 | Comp. |
| 4 | C | 18 | Comp. |
| 5 | B-C | 26 | Comp. |
| 6 | B-C | 24 | Comp. |
| 7 | B | 13 | Inv. |
| 8 | B | 12 | Inv. |
| 9 | B | 14 | Inv. |

TABLE 1-continued

| Processing No. | Unevenness in Process | Process Stability | Remark |
|---|---|---|---|
| 10 | B | 6 | Inv. |
| 11 | A-B | 8 | Inv. |
| 12 | A | 6 | Inv. |
| 13 | A-B | 3 | Inv. |
| 14 | A-B | 2 | Inv. |
| 15 | A | 8 | Inv. |
| 16 | A | 1 | Inv. |

Example 2

From processed color negative films obtained in Example 1 and dried similarly to Example 1, R, G and B separation negative images were obtained using a lamp JCR-12V-50WG (50 W. available from USHIO DENKI Co., Ltd.) and a 2048×2048 pixel monochromatic CCD camera (KX4, available from Eastman Kodak Co.), in which a red separation filter (No. W26, available from Eastman Kodak Co.), green separation filter (No. W99, available from Eastman Kodak Co.) or blue separation filter (No. W98, available from Eastman Kodak Co.) was arranged between the light source and a sample. The thus obtained RGB data were outputted as a color print on Konica Color Paper Type QAA7 of A4-size (210 mm×297 mm), using a LED printer (product by Konica Corp) at a resolving power of 300 dpi. As a result, process stability achieved in Example 1 was further enhanced by 5% or more.

Further, when the drying condition was varied so as to make the coating weight of the processing solution at the time of reading by scanner 0.8 times the maximum water absorption amount, evaluation was similarly conducted. Furthermore, replacing the light source for reading by a halogen light source apparatus LA-150UX (180W), available from HAYASHI TOKEIKOGYO Co., Ltd., evaluation was also made similarly. As a result, it was proved that enhancement in process stability was increased by 10 to 30%.

Example 3

Processed photographic materials (color negative films) that were subjected to reading by an image sensor, as in Example 2 and processed photographic materials that were subjected to reading by an image sensor and then to a development stop treatment were allowed to stand in a light-proof vessel maintained at 25° C. and 40% RH for 2 weeks. The thus aged photographic materials were taken out from the vessel and further subjected to processing similarly to Example 2 to obtain color prints. From the thus obtained color prints, the reflection density of a color pattern portion corresponding to a neutral color pattern having a reflection density in the vicinity of 1.0 was measured, then, the difference in density from non-aged print obtained in Example 2 (i.e., variation rate in density=variation in density/density obtained in processing of Example 2) was determined for each of Processing Nos. 1 through 16 and an average value of the differences for respective Processing Nos. 1 through 16 was compared. The less value indicates higher process stability. As a result, it was proved that the difference for samples which were subjected to the development stop treatment and then were aged was 1.3%, while that for samples which were aged without being subjected to the development stop treatment was 15.7%, indicating that samples having been subjected to the development stop treatment exhibited relatively high process stability even in the reuse of the processed samples. Of samples that were processed in Processing No. 6 and evaluated with respect to the foregoing storage stability, a sample subjected to a development stop treatment and a sample not subjected the development stop treatment were each cut to 100 $cm^2$ and immersed into 50 cc of pure water at 25° C. for 10 min. and then the pH of the water was measured. As a result, the pH for the sample subjected to the development stop treatment was 6.5, while the pH for the sample not subjected to the development stop treatment was 10.2. Thus, it was confirmed that the development stop treatment lowered the pH, enhancing safety in handling. It was also proved that replacement of the development stop treatment by a bleaching treatment or fixing treatment resulted in similar effects.

What is claimed is:

1. An image formation process of a silver halide color photographic light sensitive material comprising a support having thereon at least one silver halide emulsion layer, the process comprising the steps of:

(a) exposing the photographic material to light, and (b) coating a processing solution containing a color developing agent onto the emulsion layer side of the exposed photographic material in a coating section to perform development, while supplying the processing solution to the coating section, wherein the processing solution has a viscosity of 10.1 to 15000 cp at 25° C. and the processing solution being supplied to the coating section at a supplying rate of 0.002 to 2.0 ml/sec.

2. The image formation process of claim 1, wherein the color developing agent concentration of the processing solution is 40 to 200 mmol/l, and the coating section is arranged apart from the photographic material so that a spacing between the coating section and the photographic material is maintained at 0.8 to 15 times a total dry layer thickness of the photographic material.

3. The image formation process of claim 1, wherein the processing solution has a pH of 10.3 to 14.0.

4. The image formation process of claim 1, wherein the processing solution is comprised of at least two part solutions.

5. The image formation process of claim 1, wherein the process further comprises subjecting the developed photographic material to a squeezing treatment.

6. The image formation process of claim 1, wherein the process further comprises subjecting the developed photographic material to a development stopping treatment.

7. The image formation process of claim 1, wherein the development is performed at a temperature of 43 to 95° C.

8. The image formation process of claim 1, wherein the process further comprises (c) reading image information from the developed photographic material by an image sensor to transform the read image information into digital image information.

9. The image formation process of claim 8, wherein at step (c), the developed photographic material has a processing solution-coating weight of 0.2 to 40 times a maximum water absorption amount of the photographic material.

10. The image formation process of claim 8, wherein the image sensor is provided with a light source having an output of at least 100 W.

11. The image formation process of claim 8, wherein after completion of step (c), the photographic material is subjected to at least one selected from the group consisting of a bleaching treatment, fixing treatment and development stopping treatment.

12. The image formation process of claim 1, wherein the photographic material comprises a support having thereon a blue-sensitive silver halide photographic material containing a yellow dye forming coupler, a green-sensitive silver halide photographic material containing a magenta dye forming coupler and a red-sensitive silver halide photographic material containing a cyan dye forming coupler.

13. An image formation process of a silver halide color photographic light sensitive material comprising a support having thereon at least one silver halide emulsion layer, the process comprising the steps of:

(a) exposing the photographic material to light, (b) coating a processing solution containing a color developing agent onto the emulsion layer side of the exposed photographic material in a coating section to perform development, while supplying the processing solution to the coating section, and (c) reading image information from the developed photographic material by an image sensor to transform the read image information into digital image information, wherein the processing solution has a viscosity of 10.1 to 15000 cp at 25° C. and the processing solution is supplied to the coating section at a supplying rate of 0.002 to 2.0 ml/sec, and at step (c), the developed photographic material has a processing solution-coating weight of 0.2 to 40 times a maximum water absorption amount of the photographic material.

14. An image formation process of a silver halide color photographic light sensitive material comprising a support having thereon at least one silver halide emulsion layer, the process comprising the steps of:

(a) exposing the photographic material to light, (b) coating a processing solution containing a color developing agent onto the emulsion layer side of the exposed photographic material in a coating section to perform development, while supplying the processing solution to the coating section, and (c) reading image information from the developed photographic material by an image sensor to transform the read image information into digital image information, wherein the processing solution has a viscosity of 10.1 to 15000 cp at 25° C. and containing the color developing agent in an amount of 40 to 200 mmol/l, the processing solution being supplied to the coating section at a supplying rate of 0.002 to 2.0 ml/sec; the coating section is arranged apart from the photographic material so that a spacing between the coating section and the photographic material is maintained at 0.8 to 15 times a total dry layer thickness of the photographic material; and at step (c), the photographic material has a processing solution-coating weight of 0.2 to 40 times a maximum water absorption amount of the photographic material.

15. An image formation process of a silver halide color photographic light sensitive material comprising a support having thereon at least one silver halide emulsion layer, the process comprising the steps of:

(a) exposing the photographic material to light, (b) coating a processing solution containing a color developing agent onto the emulsion layer side of the exposed photographic material in a coating section to perform development, while supplying the processing solution to the coating section, and (c) reading image information from the developed photographic material by an image sensor to transform the read image information into a digital image information, wherein the processing solution has a viscosity of 10.1 to 15000 cp at 25° C. and a pH of 10.3 to 14.0, and the processing solution being supplied to the coating section at a supplying rate of 0.002 to 2.0 ml/sec; and at step (c), the photographic material has a processing solution-coating weight of 0.2 to 40 times a maximum water absorption amount of the photographic material.

* * * * *